US005487498A

United States Patent [19]

Gleason

[11] Patent Number: 5,487,498

[45] Date of Patent: Jan. 30, 1996

[54] SPORTING PACK WITH APPARATUS FOR CONCENTRATING WEIGHT OF PACK AT LUMBAR REGION OF WEARER

[76] Inventor: Dana W. Gleason, 409 E. Olive, Bozeman, Mont. 59715

[21] Appl. No.: 281,437

[22] Filed: Jul. 27, 1994

[51] Int. Cl.[6] ..... A45F 5/00

[52] U.S. Cl. ..... 224/224; 224/211; 224/153; 224/907

[58] Field of Search ..... 224/151, 153, 224/209, 210, 211, 212, 213, 214, 215, 224, 240, 261, 262, 907; 150/127–130; 190/127

[56] References Cited

U.S. PATENT DOCUMENTS

| | | | |
|---|---|---|---|
| 4,420,103 | 12/1983 | Douglass | 224/907 |
| 4,830,245 | 5/1989 | Arakaki | 224/210 |
| 4,982,884 | 1/1991 | Wise | 224/211 |
| 5,025,965 | 6/1991 | Smith | 224/215 |
| 5,114,059 | 5/1992 | Thatcher | 224/209 |
| 5,131,576 | 7/1992 | Turnipseed | 224/907 |
| 5,228,609 | 7/1993 | Gregory | 224/907 |
| 5,236,112 | 8/1993 | Robinson et al. | 224/211 |

FOREIGN PATENT DOCUMENTS

| | | | |
|---|---|---|---|
| 549197 | 6/1993 | European Pat. Off. | 224/211 |
| 125823 | 8/1949 | Sweden | 224/209 |
| 44295 | 1/1909 | Switzerland | 224/212 |
| 199348 | 8/1938 | Switzerland | 224/210 |

*Primary Examiner*—Henry J. Recla
*Assistant Examiner*—Gregory M. Vidovich
*Attorney, Agent, or Firm*—Richard C. Conover

[57] ABSTRACT

A back pack or fanny pack using a hip belt to secure the pack to a wearer's waist. This pack includes a padded lumbar pad positioned vertically along the lumbar region of a wearer's spine. The lumbar pad, which is constructed of flexible padding, is secured to the pack at an upper and lower surface of the lumbar pad. A padded hip belt is positioned between the lumbar pad and the pack. The hip belt is used to anchor a pair of straps, each connected to one end of a stay secured to the pack. The stay is positioned between the lumbar pad and the pack and extends across the wearer's back substantially parallel with the hip pad. When the straps are pulled taut about the body of a wearer, the stay is forced into the wearer's back causing the lumbar pad to be pressed into the lumbar region of the wearer to concentrate the weight of the pack at the lumbar region of the wearer.

5 Claims, 2 Drawing Sheets

SPORTING PACK WITH APPARATUS FOR CONCENTRATING WEIGHT OF PACK AT LUMBAR REGION OF WEARER

BACKGROUND OF THE INVENTION

This invention relates to an improved back pack support apparatus for concentrating weight of the pack at the lumbar area of a wearer's spine.

In the past, adjustable harnesses have been used to transfer weight of a backpack or fannypack to a wearer's waist by having a hip belt encircle the waist. Many of these previous efforts place a pad over the lumbar region of the spine and then use a hip belt to compress the pad against the lumbar portion of a wearer's spine. Examples of this technique can be seen in several patents such as those shown in French patent 2,669,519, U.S. Pat. No. 4,479,595, U.S. Pat. No. 5,228,609, and U.S. Pat. No. 5,236,112. Although the padding helps to protect the lumbar region of the spine, a problem still remains as the lumbar padding does not concentrate weight vertically along the complex curvature of the spine existing in the lumbar region. Because a hip belt rides just above the hips of a wearer, the hip belt also places a considerable load on the wearer's hip region.

A padded belt normally circles the waist of a wearer. Weight is distributed to the waist region when using a hip belt by compressing the padding into the waist along the longitudinal axis of the hip belt. Adjustments to the hip belt length merely changes the forces applied inwardly along the length of the belt. Even though the belt is padded, this does not permit for adjustable concentration of the weight of the pack vertically along the lumbar region of a wearer's spine. Because of the complex curvature of the lumbar, the use of additional belts circling the waist of a wearer will not concentrate the weight at the lumbar region of the wearer, because the force will be directed inwardly around the waist of the wearer along the length of the belt.

What is needed is a mechanism associated with the hip belt to concentrate weight vertically over the complex curvature of the lumbar region of a wearer's spine. The mechanism should be capable of adjustably changing the curvature of a lumbar pad to transfer weight effectively to the lumbar region of an individual, each having a uniquely shaped spine.

SUMMARY OF INVENTION

The present invention relates to an improved support apparatus which concentrates weight from a sporting pack at the lumbar region of the wearer.

Both back packs and fannypacks use a hip belt to secure the packs to a wearer's waist. The present invention uses a padded lumbar pad, positioned vertically along the lumbar region of a wearer's spine. The lumbar pad, which is constructed of flexible padding, is secured to the sporting pack at an upper and lower surface of the lumbar pad. A padded hip belt is positioned between the lumbar pad and the pack. The hip belt is used to anchor a pair of upper straps, each connected to one end of an upper stay secured to the pack. The stay is positioned between the lumbar pad and the pack and extends across the wearer's back substantially parallel with the hip belt. The hip belt also serves as an anchor for a pair of lower straps, each connected to a lower stay secured to the pack. The lower stay is of construction similar to that of the upper stay. When the upper and lower adjustable straps are pulled taut about the body of a wearer, the stays are forced into the wearer's back causing the lumbar pad to be pressed into the lumbar region of the wearer. Since the upper and lower straps are attached to the pack and the lumbar pad is secured at its upper and lower surfaces to the pack, pulling the stays against the back of the wearer concentrates the weight of the pack on the lumbar pad.

The effect of pulling the upper and lower adjustable straps taut is to conform the lumbar pad to the unique lumbar configuration of a particular wearer and to concentrate the pack weight vertically along the lumbar region.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
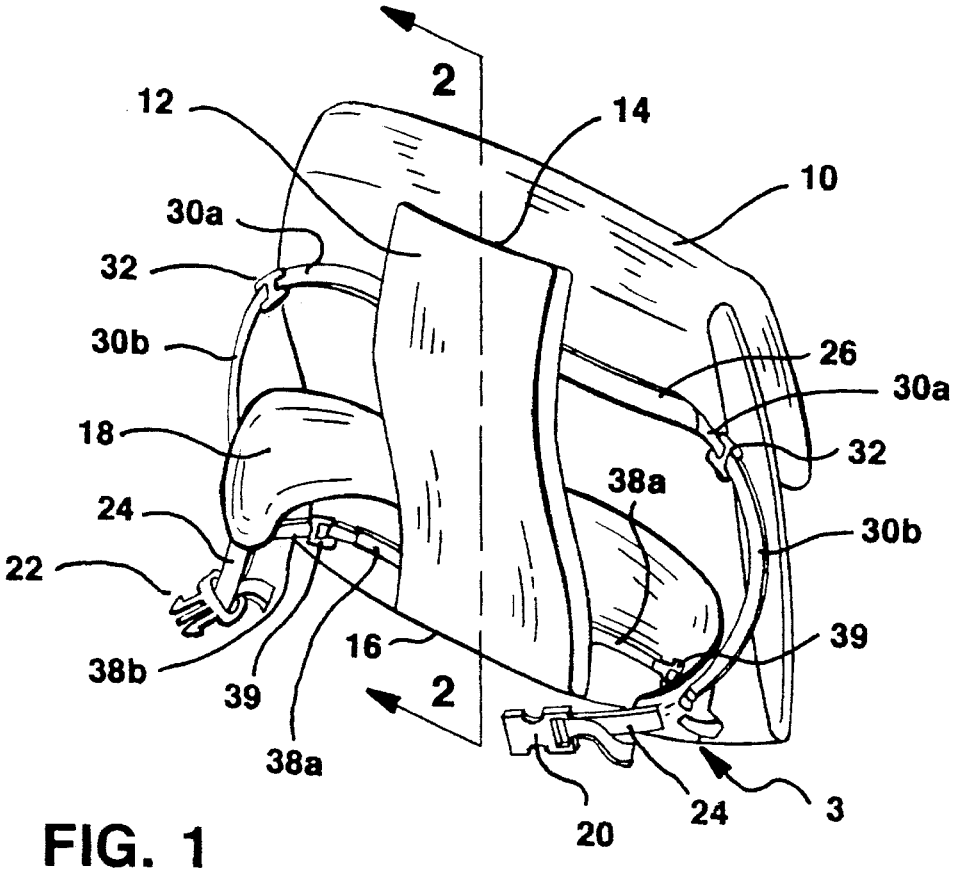
FIG. 1 is a perspective view of a pack with a support apparatus of the present invention.
Figure 3:
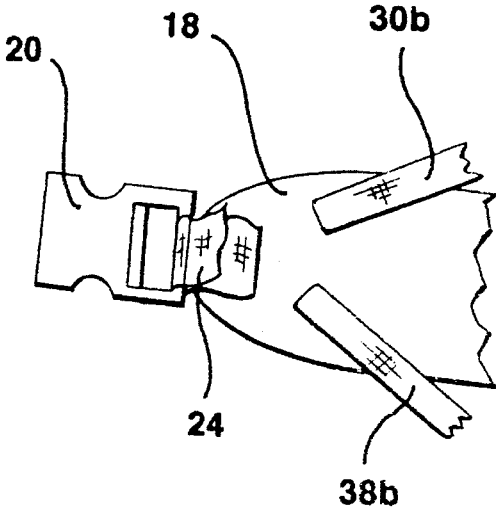
FIG. 3 is an expanded view of a portion of one end of a pack hip belt as pointed to by indicator 3 in FIG. 1.

A pack 10 is shown in FIG. 1 having a lumbar pad 12 for transferring weight of the pack to a wearer's lumbar region. In a preferred embodiment, lumbar pad 12 is constructed of flexible padding material and is stitched to pack 10 along upper surface 14 and lower surface 16 leaving the sides unstitched between the lumbar pad and the pack.

A hip belt 18 is attached to the lumbar pad 12 on the side adjacent the pack and extends out the unstitched sides between the lumbar pad and the pack. Hip belt 18 is made of a padded, flexible material. At one end, hip belt 18 has a female connector 20 and at the other end has a male connector 22 which can mate with the female connector. Both female connector 20 and male connector 22 are connected to hip belt 18 by hip belt straps 24 which straps are adjustably gripped by the connectors. Hip belt straps 24, which are a first adjusting means, can be used to adjust the length of the hip belt as the hip belt encircles the waist of a user.

Pack 10 has an elongated, stiff, upper stay 28 extending widthwise across the pack. In a preferred embodiment this stay is constructed of a fiberglass bar but could be constructed of spring steel or laminated wood or other stiffening material. This stay 28 is secured to pack 10 by being encased in an elongate bag 26 stitched to pack 10. This upper stay is positioned generally above and parallel to hip belt 18. A pair of straps 30*a*, one associated with each end of stay 28, are stitched to the respective ends of bag 26. A corresponding pair of straps 30*b* are stitched to hip belt 18. Adjusting grips 32, which are a second adjusting means, connect corresponding ends of straps 30*a* and 30*b* so that length adjustments can be made. Adjusting grips 32 permit upper straps 30*a* and 30*b* to be drawn tightly and independently of the adjustment to hip belt 18.

Since lumbar pad 12 is stitched to pack 10 along upper surface 14 and lower surface 16, drawing upper straps 30*a* and 30*b* taut causes the stay to be forced toward the wearer's back and against lumbar pad 12. This causes lumbar pad 12 to be further compressed against the lumbar region of the wearer to further concentrate the weight of the pack on the lumbar region of the wearer. Since the lumbar pad is flexible the lumbar pad is forced to conform to the curvature of the spine of the user.

Pack 10 also has an elongated, stiff lower stay 36 extending widthwise across the pack. In a preferred embodiment the stay 36 is constructed of a fiberglass bar but could be constructed of spring steel or laminated wood or other stiffening material. This stay 36 is also secured to the pack 10 by being encased in an elongate bag 34 stitched to pack 10. This lower stay is positioned generally in the region of and parallel to hip belt 18. A pair of straps 38*a*, one associated with each end of stay 36, are stitched to the respective ends of bag 34. A corresponding pair of straps 38*b* are stitched to hip belt 18. Adjusting grips 39, which are a third adjusting means, connect corresponding ends of straps 38*a* and 38*b* so that length adjustments can be made.

Figure 2:
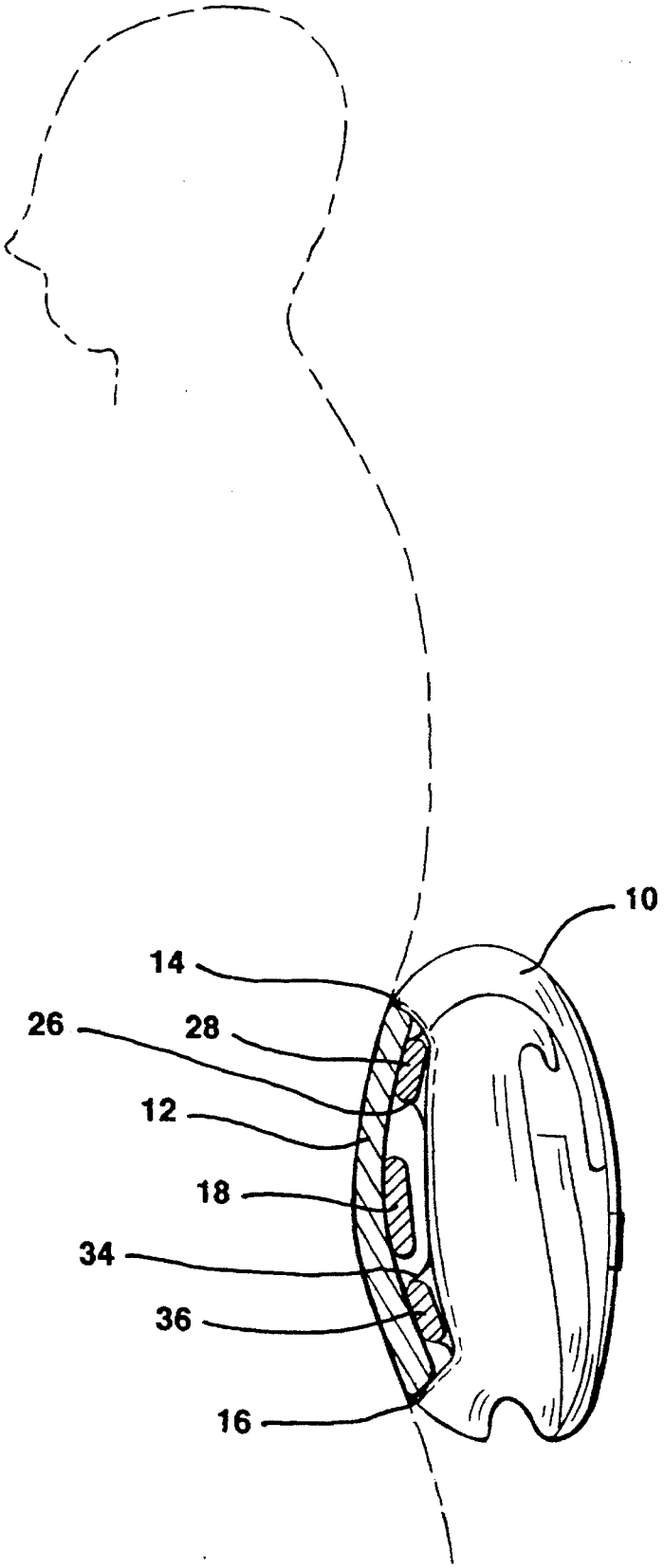
FIG. 2 is a partial cross-section of the present invention taken along the line 2—2 in FIG. 1 and positioned on the back of a wearer.

Since lumbar pad 12 is stitched along upper surface 14 and lower surface 16, drawing lower strap 38*a* and 38*b* taut causes the stiff stay 36 to be forced toward the wearer's back as shown in FIG. 2. This causes lumbar pad 12 to be further compressed against the lumbar region of the wearer to concentrate the weight of the pack on the lumbar region of the wearer. The lower stay 36 is more effective at the lower region of the lumbar pad 12 while the upper stay 28 is more effective at the upper region of the lumbar pad.

In operation, pack 10 is placed on a wearer's fanny or back, and hip belt 18 fastened using female connector 20 to mate with male connector 22. Hip belt straps 24 can then be tightened to make hip belt 18 snug around a wearer's waist and drawing the lumbar pad 12 firmly against the lumbar region of the user.

Then upper straps 30*a* and 30*b* can be drawn taut by pulling the upper straps through adjusting grips 32 so as to force stay 28 against the lumbar pad 12. This puts additional curvature in lumbar pad 12 and places additional pressure on the upper lumbar to assist in supporting pack 10.

Lower strap 38*a* and 38*b* can then be drawn taut by pulling the lower straps through adjusting grips 32 so as to force stiff stay 36 against lumbar pad 12. This puts additional curvature in the lower regions of lumbar pad 12 and places additional pressure on the lower lumbar to assist in supporting pack 10.

It can be seen that the stays 28 and 36 are used to shape the flexible lumbar pad 12 to conform to the unique shape of the wearer's lumbar region. Thus the weight of the pack is concentrated and uniformly distributed over the lumbar region of the wearer.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. A sporting pack having an apparatus for transferring weight of the pack to a lumbar region of a wearer, comprising:

a pack;

a lumbar pad having an upper surface and lower surface and attached to the pack at the upper and lower surfaces;

a hip belt positioned between the lumbar pad and the pack for encircling a waist of the wearer;

an elongate, first stay having opposite ends and being disposed between the lumbar pad and the pack and spaced apart from the hip belt, the first stay extending substantially parallel with the hip belt widthwise across the pack and first attachment means coextensive with said first stay for attaching said first stay to said pack, said attachment means having opposite end portions; and a first pair of strap means connected to each end portion of the first attachment means, respectively, and opposite ends connected to the hip belt, respectively for forcing the stay against the lumbar pad in a direction into the back of the wearer.

2. The sporting pack of claim 1 further including:

an elongate, second stay having opposite ends and being disposed between the lumbar pad and the pack and spaced apart from the first stay, the second stay extending substantially parallel with the hip belt and widthwise across the pack and second attachment means coextensive with said second stay for attaching said second stay to said pack, said second attachment means having opposite end portions;

a second pair of strap means having first ends connected to each end portion of the second attachment means, respectively, and opposite ends connected to the hip belt, respectively, for forcing the second stay against the lumbar pad into the back of the wearer.

3. The sporting pack of claim 1 further including:

a first means for adjusting the length of the hip belt.

4. The sporting pack apparatus of claim 1 further including:

a means for adjusting the length of the first pair of strap means.

5. The sporting pack of claim 2 further including:

a means for adjusting the length of the second pair of strap means.

* * * * *